US007337936B2

(12) United States Patent
Ishida et al.

(10) Patent No.: US 7,337,936 B2
(45) Date of Patent: Mar. 4, 2008

(54) CONTINUOUS PAPER TRANSPORTING MECHANISM AND PRINTING APPARATUS HAVING THE SAME

(75) Inventors: Shigeo Ishida, Kanagawa (JP); Masato Matsuduki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 81 days.

(21) Appl. No.: 10/698,482

(22) Filed: Nov. 3, 2003

(65) Prior Publication Data

US 2004/0140387 A1 Jul. 22, 2004

(30) Foreign Application Priority Data

Nov. 5, 2002 (JP) ..... 2002-321350

(51) Int. Cl.
*B65H 20/34* (2006.01)
*B41J 15/16* (2006.01)

(52) U.S. Cl. ..... 226/143; 226/8; 226/17; 226/152; 400/618

(58) Field of Classification Search ..... 226/8, 226/39, 42, 43, 120, 122, 134, 135, 136, 226/143, 152, 115, 118.1, 118.2, 118.3, 195, 226/17, 196.1; 400/613, 613.2, 617, 618, 400/619; 242/615.1, 615.3, 418, 418.1
See application file for complete search history.

(56) References Cited

U.S. PATENT DOCUMENTS 980,277 A * 1/1911 Ireland ..... 400/617
3,727,820 A * 4/1973 Braun ..... 226/113
4,009,814 A * 3/1977 Singh ..... 226/113
4,223,822 A * 9/1980 Clitheroe ..... 226/42
4,603,800 A * 8/1986 Focke et al. ..... 242/417.2
4,657,164 A * 4/1987 Felix ..... 226/42
5,166,736 A * 11/1992 Ogawa et al. ..... 399/322
5,472,127 A * 12/1995 Ichii et al. ..... 226/44
5,597,105 A * 1/1997 Keller ..... 226/118.3
5,685,471 A * 11/1997 Taubenberger ..... 226/17
6,592,276 B2 * 7/2003 Ohba et al. ..... 400/582

FOREIGN PATENT DOCUMENTS

JP A 7-247045 9/1995
JP A 9-86742 3/1997
JP A 9-507666 8/1997

* cited by examiner

*Primary Examiner*—Peter M. Cuomo
*Assistant Examiner*—Scott Haugland
(74) *Attorney, Agent, or Firm*—Oliff & Berridge, PLC

(57) ABSTRACT

A printing apparatus having a mechanism for transporting continuous paper includes: a frictionally transporting section for frictionally transporting the continuous paper; a paper braking section provided on an upstream side of the frictionally transporting section; a paper-position restricting section constituted by a pair of rollers arranged between the frictionally transporting section and the paper braking section obliquely at a predetermined angle θ with respect to a paper transporting direction; a buffer device provided between the paper-position restricting section and the frictionally transporting section to absorb slack of the paper; and a printing section disposed on a downstream side of the frictionally transporting section.

11 Claims, 3 Drawing Sheets

FIG. 1
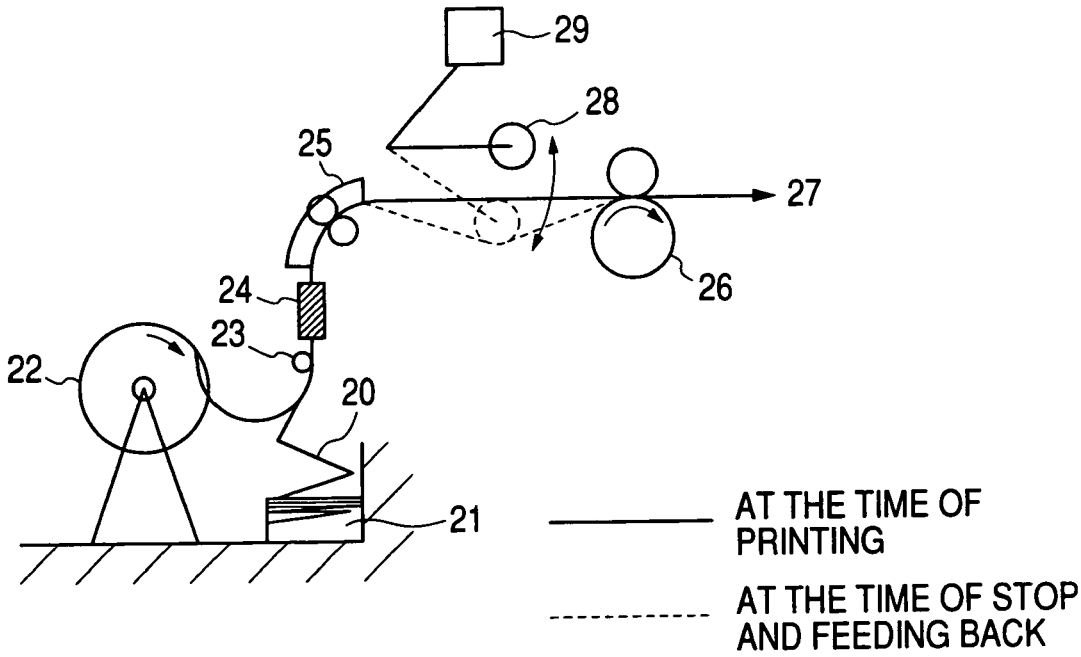
FIG. 2 - PRIOR ART
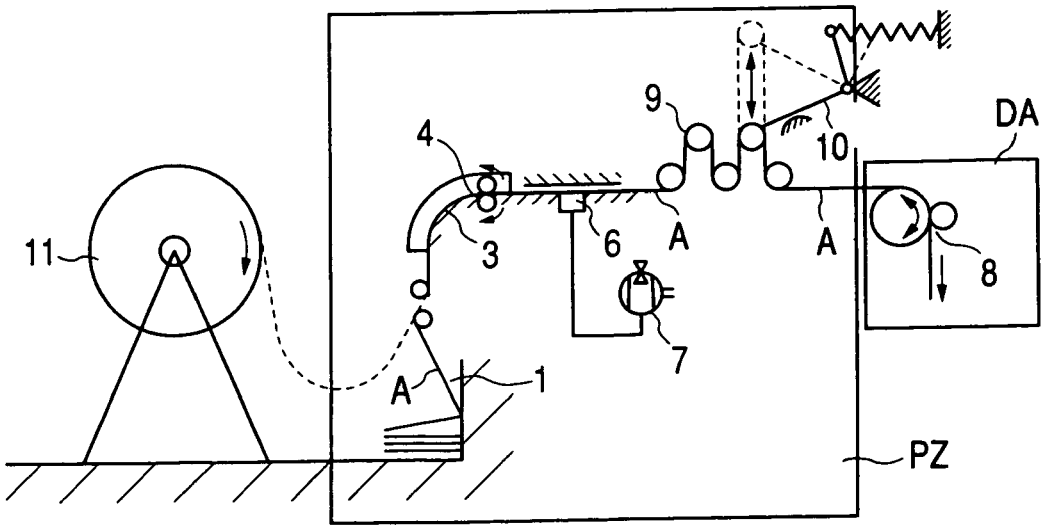

TIMING OF THE PAPER POSITION, THE DRIVE ROLLER, AND THE BUFFER PORTION AT THE TIME OF A PRINTING STOP

TIMING OF THE PAPER POSITION, THE DRIVE ROLLER, AND THE BUFFER PORTION AT THE TIME OF A PRINTING START

CONTINUOUS PAPER TRANSPORTING MECHANISM AND PRINTING APPARATUS HAVING THE SAME

BACKGROUND OF THE INVENTION

1. Field of the Invention

The present invention relates to a printing apparatus and a transporting mechanism for transporting continuous paper, and more particularly to a printing apparatus having a continuous-paper transporting mechanism for stably transporting continuous paper which is not provided with feeding perforations, as well as a continuous-paper transporting mechanism suitable for use in such a printing apparatus.

2. Description of the Related Art

Conventionally, in cases where continuous paper is printed by a printer, feeding perforations provided continuously at equal intervals in the feeding direction are provided in advance on each side of the continuous paper. Meanwhile, a tractor having pins which fit in the feeding perforations in the continuous paper is provided on the printer side, and the continuous paper is transported as this tractor rotates.

For this reason, predetermined feeding perforations must be provided in the paper. In addition, not only are portions at both side edges of the paper unable to be used for printing, but they become unnecessary after printing, so that they must be disposed of by such as cutting the both side edge portions in post-processing. For this reason, there has been a demand for a technique for transporting continuous paper which is free of feeding perforations from the viewpoint of paper processing cost and the like.

a conventional technique for transporting continuous paper which is free of feeding perforations is disclosed in JP-T-9-507666. The technique disclosed in the document JP-T-9-507666 is shown in FIG. 2.

In FIG. 2, reference symbol "A" denotes paper; reference symbol "PZ" denotes a paper device; reference symbol "DA" denotes a printing unit; reference numbers 1 and 11 denotes a paper input device; reference numbers 2 and 4 denotes rollers; reference number 3 denotes a paper centering device; reference number 6 denotes a vacuum brake; reference number 7 denotes a vacuum pump; reference number 8 denotes a friction drive; reference number 9 denotes a stabilization roller; and reference number 10 denotes a festoon device.

The mechanism for transporting continuous paper free of feeding perforations is provided with a paper braking member (vacuum brake 6) for braking the paper with respect to the transporting direction by sucking the continuous paper between the friction drive, i.e., the pair of drive rollers 8, and the upstream side of the pair of drive rollers 8. In a course of the continuous paper, a paper-position restricting mechanism (centering device 3) is provided for keeping the position of the paper at a prescribed position in a direction perpendicular to the paper transporting direction. The paper-position restricting mechanism is constituted by the pair of rollers 4 disposed obliquely at an angle θ with respect to the paper feeding direction.

The vacuum brake 6, the mechanical accumulator 9, the festoon device 10 for imparting tension to the paper are respectively provided between the paper-position restricting mechanism 3 and the pair of frictionally transporting drive rollers 8, so as to fix the tension of the paper and stabilize the paper transport.

Here, in the continuous paper printing apparatus, at the time of the starting or stopping of printing, certain time is required for achieving build-up to a fixed speed or stopping from the fixed speed in the light of the characteristics of a transport motor for driving the paper transport. Therefore, control is provided in which build-up is achieved up to a fixed speed while the continuous paper is transported a certain length A, and the transport is stopped at a point of time when the continuous paper has been transported a certain length B at the time of stopping. To eliminate the positional offset A+B of the paper at the time of the starting or stopping of printing, control is generally provided such that the continuous paper is transported in the opposite direction by a portion corresponding to the length of A+B, to thereby effect printing continuously without providing wasteful margins.

In the known example described above, when a slack occurs in the continuous paper at the time when the paper is transported in the opposite direction, paper skew occurs, and the traveling of the paper ceases to be stable. Therefore, the paper-position restricting mechanism absorbs the paper slack by unit of the festoon device 10 to suppress the slack of the paper, thereby preventing the paper skew.

Other examples disclosed in JP-A-7-247045 and in JP-A-9-086742 are known as a conventional technique. The document JP-A-7-247045 discloses that the operation and releasing of a curl straightening mechanism for recording paper are effected by a simple mechanism, and that a pressure contact roller is reversely rotated to improve the filing characteristic of the recording paper. Namely, as a unit for releasing the recording paper from the curl straightening mechanism, the recording paper is fed in the opposite direction after completion of recording, and the recording paper is moved away from an inverse warping part of the curl straightening mechanism, thereby preventing a curl from being formed at the time of non-recording.

In the document JP-A-9-086742, in a continuous paper transporting mechanism having a paper feed tractor for transporting continuous paper from a hopper toward a photosensitive drum, to prevent the dislocation of the continuous paper and prevent the occurrence of transfer bleeding at the time of a printing start, a paper braking member is provided for braking the continuous paper in the transporting direction by pinching the paper surface of the continuous paper on the upstream side of the paper feed tractor, and a buffer unit for absorbing the slack of the continuous paper is spring-urged between this paper braking member and the paper feed tractor so as to constantly come into contact with the paper surface of the continuous paper and push it out.

However, the known example (FIG. 2) disclosed in the document JP-T-9-507666 has the following drawback.

Since the vacuum brake 6, the mechanical accumulator 9, and the festoon device 10 are respectively provided for imparting tension to the paper, the number of component parts increases, so that the cost and size of the apparatus become large.

End faces of the paper are positioned by the paper-position restricting mechanism 3, and the paper is transported by the pair of frictionally transporting drive rollers 8. However, since the accumulator 9 arranged so as to allow the paper to be wound therearound, a roller provided in the festoon device 10, and the like are present between the paper-position restricting mechanism 3 and the pair of frictionally transporting drive rollers 8, paper skew components are generated with respect to the direction of transport by these rollers, so that the parts accuracy and the mounting accuracy of the respective rollers must set strictly.

In addition, since the position of a swing roller provided in the festoon device 9 of the accumulator changes during printing, and the amount of paper wound around the roller changes. Therefore, the skew component imparted by the swing roller to the paper changes due to the amount of paper wound around the moving roller, so that the drifting action of this portion is unavoidable.

In addition, as a conventional known method other than the known examples described above, there is a technique in which, instead of providing the paper braking member on the upstream side of the pair of frictionally transporting drive rollers, a transporting mechanism is provided for effecting the transport of paper to a hopper section, and control is provided so as to reversely transport the paper at the time of back feeding of the paper. However, according to this method, at the time of reverse transport, the driving of the paper-position restricting mechanism consisting of a pair of rollers disposed obliquely with respect to the paper transporting direction is controlled, and the setting of an angle θ with respect to the paper transporting direction must be changed. Therefore, the mechanism and the controlling method become complex, the number of components increases, and the size of the apparatus also becomes disadvantageous.

SUMMARY OF THE INVENTION

Therefore, an object of the invention of the present invention is to prevent the skew of the paper and improve the accuracy of the printing position at the time of printing in a case where continuous paper which is free of feeding perforations is transported stably.

In order to achieve the object, according to a first aspect of the present invention, there is provided a printing apparatus including: a printing unit configured to print an image onto a continuous paper; and a continuous paper transporting mechanism configured to transport the continuous paper, wherein the continuous paper transporting mechanism includes: a frictionally transporting section configured to frictionally transport the continuous paper; a paper braking section provided on an upstream side of the frictionally transporting section and configured to put brake on the transportation of the continuous paper; a paper-position restricting section having a pair of rollers arranged between the frictionally transporting section and the paper braking section obliquely at a predetermined angle θ with respect to a paper transporting direction; and a buffer unit provided between the paper-position restricting section and the frictionally transporting section and configured to absorb slack of the paper, and wherein the printing section is disposed on a downstream side of the frictionally transporting section.

According to a second aspect of the present invention, there is provided a continuous paper transporting mechanism including: a frictionally transporting section configured to frictionally transport the continuous paper; a paper braking section provided on an upstream side of the frictionally transporting section and configured to put brake on the transportation of the continuous paper; a paper-position restricting section having a pair of rollers arranged between the frictionally transporting section and the paper braking section obliquely at a predetermined angle θ with respect to a paper transporting direction; and a buffer unit provided between the paper-position restricting section and the frictionally transporting section and configured to absorb slack of the paper.

BRIEF DESCRIPTION OF THE DRAWINGS

The above objects and advantages of the present invention will become more apparent by describing in detail preferred exemplary embodiment thereof with reference to the accompanying drawings, wherein:

FIG. 1 is a diagram schematically illustrating a printing apparatus having a continuous paper transporting mechanism according to the invention;

FIG. 2 is a diagram illustrating a printing apparatus having a continuous paper transporting mechanism according to a known example;

DETAILED DESCRIPTION OF THE PREFERRED EMBODIMENTS

Figure 3:
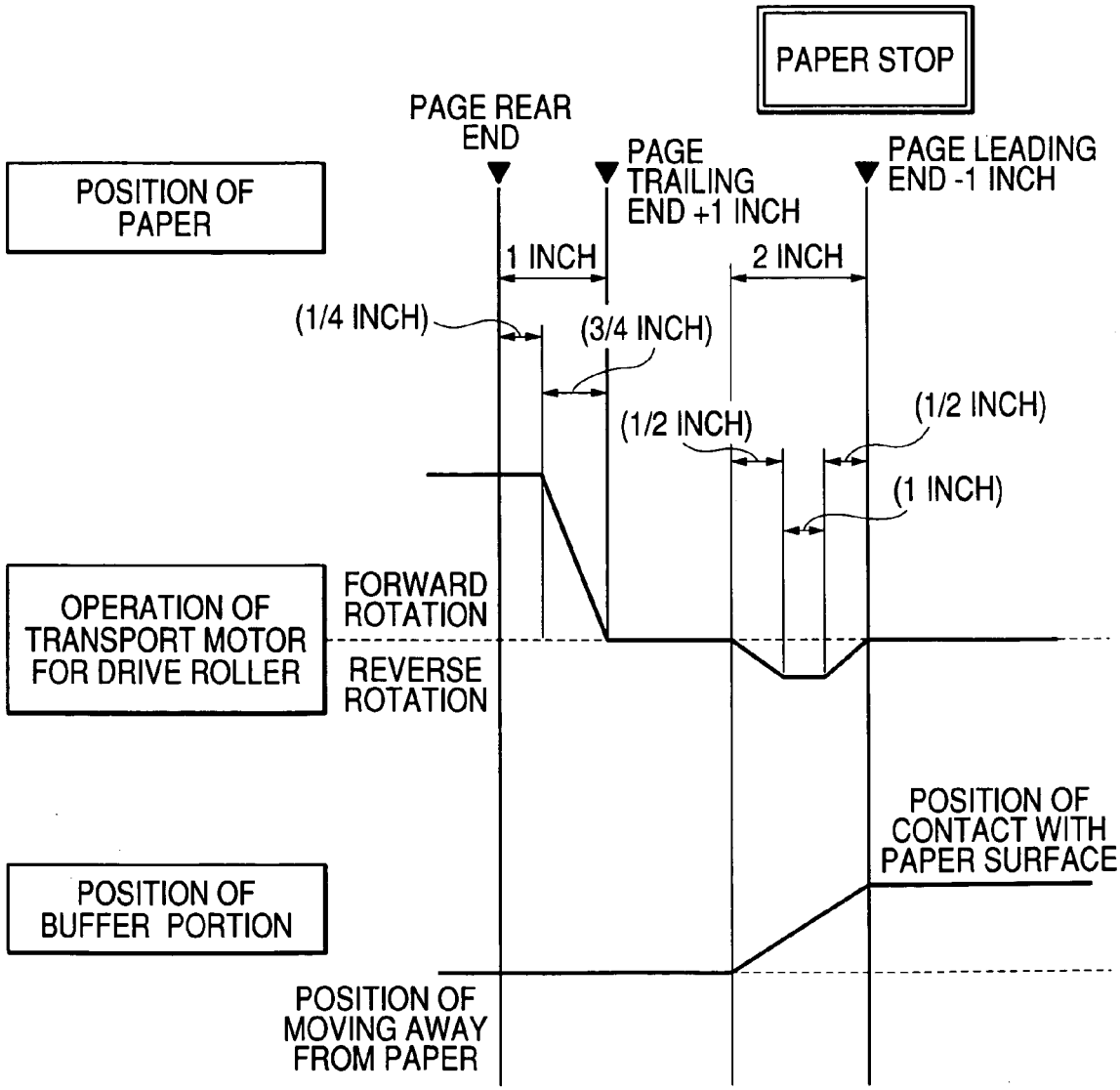
FIG. 3 is a timing chart illustrating the relationship among the position of continuous paper, a drive roller, and a buffer portion at the time of a printing stop.

Referring now to the accompanying drawings, a description will be given in detail of a preferred embodiment of the invention.

FIG. 1 schematically illustrates a printing apparatus having a continuous paper transporting mechanism in accordance with the invention.

In a paper feeding section for feeding continuous paper 20 which is free of feeding perforations, in a case where the continuous paper 20 is continuous paper in a folded form, the continuous paper in the folded form is set in a hopper 21, and the continuous paper 20 is paid out continuously from this hopper 21. Meanwhile, in a case where the continuous paper 20 is continuous paper in roll form, the continuous paper wound around a roll 22 is paid out continuously. In this case, it is preferable to separately provide a unit for controlling the driving of the roll 22 although it is not shown.

The continuous paper 20 paid out from the paper feeding section is passed along a roller 23, is passed through a paper braking section or tension imparting section 24, a paper-position restricting section 25, and a paper frictionally-transporting section 26, and is transported to a printing section 27.

The paper frictionally-transporting section 26 for frictionally transporting the continuous paper 20 which is free of feeding perforations consists of a pair of drive rollers 26. Namely, one of the pair of rollers 26 is a drive roller, and the other roller is an opposing roller. As the drive roller is rotatively driven, the continuous paper 20 is transported in the transporting direction by the frictional force of the pair of rollers against the braking force of the paper braking section 24. The paper-position restricting section 25, which consists of a pair of rollers disposed obliquely with respect to an axis perpendicular to the paper transporting direction, is provided between the pair of drive rollers 26 and the paper braking section 24 provided on an upstream side thereof. The paper-position restricting section 25 solely functions to restrict one side edge of the continuous paper 20 to a predetermined position without imparting a braking force to the continuous paper 20.

A buffer roller or guide member 28 is provided between the paper-position restricting section 25 and the pair of frictionally transporting drive rollers 26. The buffer roller or guide member 28 is so driven as to absorb the slack of the paper by coming into contact with the surface of the continuous paper 20 as the buffer roller or guide member 28 is driven by a driving unit 29 such as an unillustrated motor in correspondence with an amount of back feed for transporting the continuous paper 20 in an opposite direction when the pair of frictionally transporting drive rollers 26 are reversely rotated at the time of a printing stop.

The roller or guide member 28 is provided in such a manner as to be completely spaced apart from the continuous paper 20 during the printing of the apparatus. Namely, the roller or guide member 28 is arranged to be spaced apart from a linear transporting passage of the continuous paper 20 between the paper frictionally-transporting section 26 and the paper-position restricting section 25. Accordingly, the tension applied to the continuous paper 20 from the paper braking section 24 up to the pair of frictionally transporting drive rollers 26 assumes a predetermined value during printing. The traveling of the continuous paper 20 is stabilized since the continuous paper 20 is positioned such that its paper edges are set at predetermined positions by the paper-position restricting section 25 consisting of the pair of rollers disposed obliquely at a predetermined angle θ with respect to the paper transporting direction.

In addition, as described above, since the roller or guide member 28, which is a buffer unit, is spaced apart from the surface of the continuous paper 20 during printing, there is no factor producing skew in the continuous paper 20 between the paper-position restricting section 25 and the pair of frictionally transporting drive rollers 26. Hence, the drifting action does not occur, and paper skew does not occur, thereby making it possible to improve the printing accuracy.

Furthermore, a mechanical accumulator or the like, which was conventionally required in the known example, is not required between the paper-position restricting section 25 and the pair of frictionally transporting drive rollers 26. Hence, the number of component parts decreases, thereby making it possible to reduce the cost and size of the apparatus.

Furthermore, a driving unit such as a roller is not required for the paper braking section 24, and a drive controlling mechanism is not provided for the paper-position restricting section 25. Therefore, it is unnecessary to provide intricate control for driving the driving unit, so that the number of component parts is made small, and it is possible to reduce the cost and size of the apparatus.

The buffer portion consisting of the roller or guide member 28 is spaced apart from the surface of the continuous paper 20 during the printing of the apparatus, but is driven by the driving unit 29 at the time of a printing stop or start. The roller or guide member 28, when driven, is brought into contact with the surface of the continuous paper 20, and acts to push it out. At that juncture, since the frictional force exerted by the paper frictionally-transporting section 26 upon the continuous paper 20 is greater than the tension imparted by the paper braking section or tension imparting section 24 upon the continuous paper 20, the continuous paper 20 is pushed out against the frictional force of the frictionally transporting section 26 in accordance with the operation of the roller or guide member 28, and is moved away from the linear transporting passage persisting during printing.

FIG. 3 is a timing chart illustrating the relationship among the position of the continuous paper 20, the frictionally transporting drive rollers 26, and the buffer portion 28 at the time of a printing stop. As shown, the pair of drive rollers 26 transport the paper by a greater amount by one inch (25 mm) from a rear end of the page of the print until the motor is stopped, and the pair of driver rollers 26 then stop. After stopping, the drive roller 26 is reversely rotated, the buffer portion 28 is driven slightly earlier than the timing for returning the continuous paper 20, and the driving of the buffer portion 28 is stopped slightly later than the timing at which the drive roller 26 stops its reverse rotation.

The buffer portion 28 is driven at a speed for absorbing the slack of the continuous paper 20 occurring during the reverse rotation of the drive roller. Namely, the buffer portion 28 controls its pushing-out amount in correspondence with the amount of back feed at the time of termination of printing. Consequently, the paper is stopped in a state in which it is returned by one inch (25 mm) more than when an ensuing page is printed. Since the occurrence of a slack in the continuous paper 20 can be prevented, the position of the continuous paper 20 is not offset.

Figure 4:
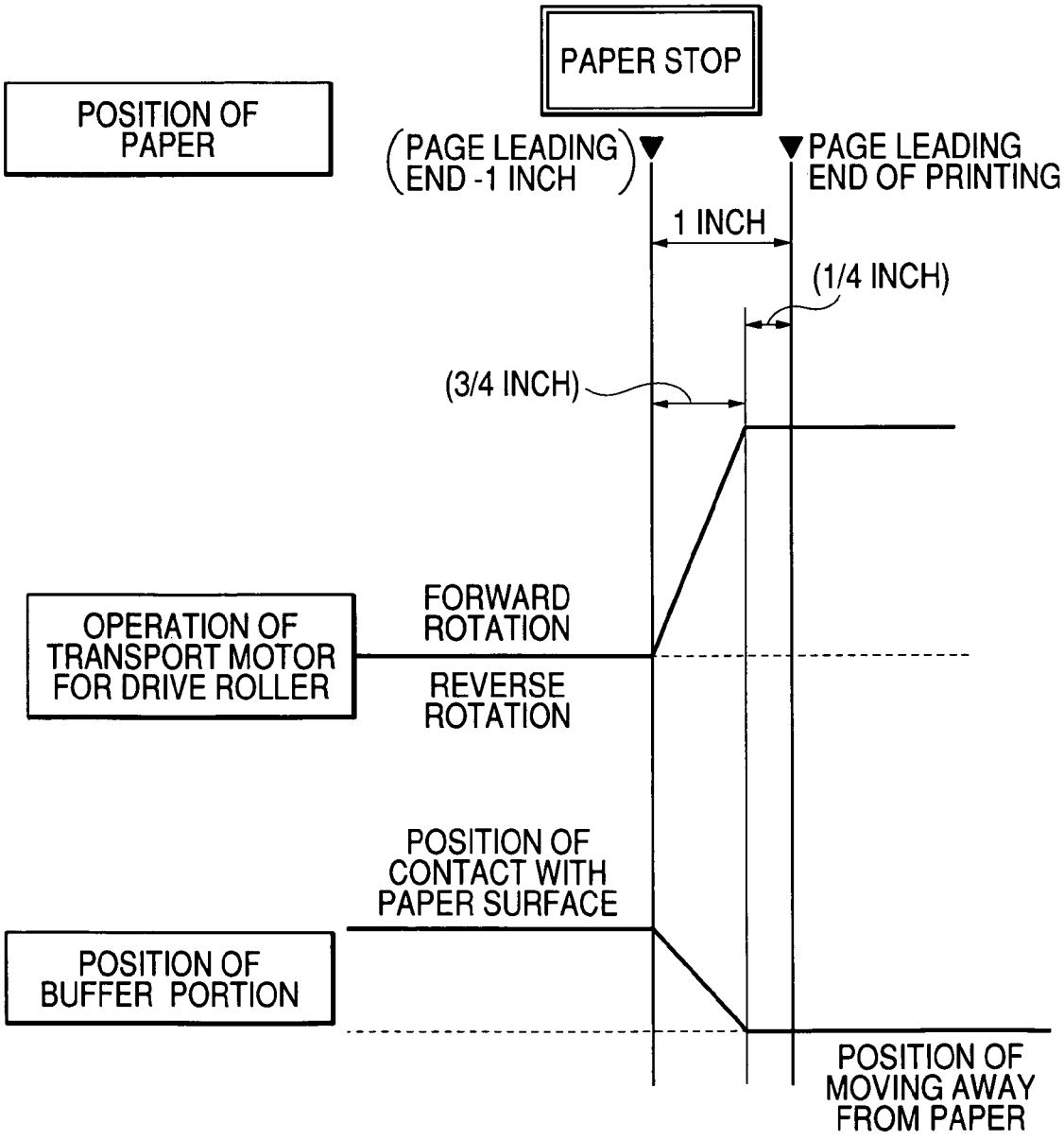
FIG. 4 is a timing chart illustrating the relationship among the position of the continuous paper, the drive roller, and the buffer portion at the time of a printing start.

FIG. 4 is a timing chart illustrating the relationship among the position of the continuous paper, the frictionally transporting drive rollers 26, and the buffer portion 28 at the time of a printing start. As shown, the continuous paper 20 at the time of the printing start is stopped at a position in which the paper is returned by one inch (25 mm) from a leading end of the page for printing. At the time of the printing start, the driving of the buffer portion 28 is started simultaneously with the rise of the drive roller 26. As the drive roller 26 is forwardly rotated, the continuous paper 20 is transported, and the buffer portion 28 is moved away from the surface of the continuous paper 20 correspondingly as the amount of buffer of the continuous paper is decreased by the buffer portion 28. Therefore, at the point of time of the printing start, the paper slack does not occur, and the position of the continuous paper 20 is not offset.

Although a description has been given of the embodiment of the invention with reference to the accompanying drawings, the invention is not limited to the above-described embodiment, and various forms, modifications, and corrections are possible within the spirit and scope of the invention.

As described above, according to the printing apparatus having a continuous paper transporting mechanism for transporting continuous paper which is free of feeding perforations in accordance with the invention, advantages are offered in that the paper skew of the continuous paper can be prevented, and transport of the paper can be effected accurately and stably, thereby making it possible to improve the printing accuracy.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A printing apparatus comprising:

a printing unit configured to print an image onto a continuous paper; and a continuous paper transporting mechanism configured to transport the continuous paper, wherein the continuous paper transporting mechanism comprises:

a frictionally transporting section configured to frictionally transport the continuous paper in a first direction, the frictionally transporting section including a back feeding unit configured to feed back the continuous paper in a second opposite direction by a predetermined amount after completion of printing;

a paper braking section provided on an upstream side of the frictionally transporting section and configured to put brake on the transportation of the continuous paper;

a paper-position restricting section having a pair of rollers arranged between the frictionally transporting section and the paper braking section obliquely at a predetermined angle θ with respect to a paper transporting direction; and a buffer unit provided between the paper-position restricting section and the frictionally transporting section and operable to come into contact with a surface of the continuous paper when the continuous paper is feeding back, and to separate from the surface of the continuous paper when the printing unit is printing, and a control unit that controls the operation of the buffer unit, in correspondence with the operation of the back feeding unit, to come into contact with a surface of the continuous paper when the continuous paper is feeding back, and that controls the operation of the buffer unit to separate from the surface of the continuous paper when the printing unit is printing, wherein the printing unit is disposed on a downstream side of the frictionally transporting section.

2. The printing apparatus as claimed in claim 1, wherein the frictionally transporting section comprises a pair of drive rollers by which the continuous paper is frictionally transported therebetween.

3. The printing apparatus as claimed in claim 1, wherein the buffer unit starts driving before the frictionally transporting section starts feeding back the continuous paper, and the buffer unit stops driving after the frictionally transporting section stops feeding back the continuous paper.

4. The printing apparatus as claimed in claim 1, wherein the buffer unit simultaneously starts driving when the frictionally transporting section starts to transport the continuous paper at the time of printing, and the buffer unit is moved away from the surface of the continuous paper correspondingly as an amount of buffer of the continuous paper is decreased.

5. A printing apparatus comprising:

a printing unit configured to print an image onto a continuous paper; and a continuous paper transporting mechanism configured to transport the continuous paper, wherein the continuous paper transporting mechanism comprises:

a frictionally transporting section configured to frictionally transport the continuous paper in a first direction, the frictionally transporting section including a back feeding unit configured to feed back the continuous paper in a second opposite direction by a predetermined amount after completion of printing;

a paper braking section provided on an upstream side of the frictionally transporting section and configured to put brake on the transportation of the continuous paper;

a paper-position restricting section having a pair of rollers arranged between the frictionally transporting section and the paper braking section obliquely at a predetermined angle θ with respect to a paper transporting direction; and a buffer unit provided between the paper-position restricting section and the frictionally transporting section and operable to come into contact with a surface of the continuous paper when the continuous paper is feeding back, and to separate from the surface of the continuous paper when the printing unit is printing, wherein the buffer unit comprises a pushing-out member configured to push out a surface of the continuous paper by coming into contact with the surface, the apparatus further comprises a pushing-out-amount controlling unit that controls an amount of push out by the pushing-out member in correspondence with an amount of the feeding back by the frictionally transporting section when the continuous paper is feeding back, and that controls the amount of push out by the pushing out member to separate the pushing out member from the surface of the continuous paper when the printing unit is printing, and the printing unit is disposed on a downstream side of the frictionally transporting section.

6. The printing apparatus as claimed in claim 5, wherein the pushing-out member comprises at least one of a roller and a guide member, and is located at a position spaced apart from the continuous paper during printing.

7. A continuous paper transporting mechanism comprising:

a frictionally transporting section configured to frictionally transport the continuous paper in a first direction, the frictionally transporting section including a back feeding unit configured to feed back the continuous paper in a second opposite direction by a predetermined amount after completion of printing;

a paper braking section provided on an upstream side of the frictionally transporting section and configured to put brake on the transportation of the continuous paper;

a paper-position restricting section having a pair of rollers arranged between the frictionally transporting section and the paper braking section obliquely at a predetermined angle θ with respect to a paper transporting direction; and a buffer unit provided between the paper-position restricting section and the frictionally transporting section and operable to come into contact with a surface of the continuous paper when the continuous paper is feeding back, and to separate from the surface of the continuous paper when the printing unit is printing; and a control unit that controls the operation of the buffer unit, in correspondence with the operation of the back feeding unit, to come into contact with a surface of the continuous paper when the continuous paper is feeding back, and that controls the operation of the buffer unit to separate from the surface of the continuous paper when the printing unit is printing.

8. The continuous paper transporting mechanism as claimed in claim 7, wherein the frictionally transporting section comprises a pair of drive rollers by which the continuous paper is frictionally transported therebetween.

9. The continuous paper transporting mechanism as claimed in claim 7, wherein the buffer unit starts driving before the frictionally transporting section starts feeding back the continuous paper, and the buffer unit stops driving after the frictionally transporting section stops feeding back the continuous paper.

10. The continuous paper transporting mechanism as claimed in claim 7, wherein the buffer unit simultaneously starts driving when the frictionally transporting section starts to transport the continuous paper at the time of printing, and the buffer unit is moved away from the surface of the continuous paper correspondingly as an amount of buffer of the continuous paper is decreased.

11. A printing apparatus comprising:

a printing unit configured to print an image onto a continuous paper; and a continuous paper transporting mechanism configured to transport the continuous paper, wherein the continuous paper transporting mechanism comprises:

a frictionally transporting section configured to frictionally transport the continuous paper in a first direction, the frictionally transporting section including a back feeding unit configured to feed back the continuous paper in a second opposite direction by a predetermined amount after completion of printing, a buffer unit provided between the paper-position restricting section and the frictionally transporting section and operable to come into contact with a surface of the continuous paper when the continuous paper is feeding back, and to separate from the surface of the continuous paper when the printing unit is printing, a control unit that controls the operation of the buffer unit, in correspondence with the operation of the back feeding unit, to come into contact with a surface of the continuous paper when the continuous paper is feeding back, that controls the operation of the buffer unit to separate from the surface of the continuous paper when the printing unit is printing, wherein the printing unit is disposed on a downstream side of the frictionally transporting section.

* * * * *